US006932535B2

(12) United States Patent
De La Fuente-Farias

(10) Patent No.: US 6,932,535 B2
(45) Date of Patent: Aug. 23, 2005

(54) PIVOTING JOINT FOR PIVOTALLY JOINING A BRAKE HEAD TO A BRAKE BEAM

(75) Inventor: Jorge Alberto De La Fuente-Farias, Nuevo León (MX)

(73) Assignee: Acertek, S.A. de C.V., Nuevo Leon (MX)

( * ) Notice: Subject to any disclaimer, the term of this patent is extended or adjusted under 35 U.S.C. 154(b) by 0 days.

(21) Appl. No.: 10/395,748

(22) Filed: Mar. 24, 2003

(65) Prior Publication Data

US 2004/0190979 A1 Sep. 30, 2004

(51) Int. Cl.[7] ..... F16B 12/44; B61H 13/00

(52) U.S. Cl. ..... 403/65; 403/290; 188/53; 188/219.1

(58) Field of Search ..... 403/65, 68, 109.3, 403/109.4, 290; 188/29, 52, 53, 57, 219.1, 220.1

(56) References Cited

U.S. PATENT DOCUMENTS 448,720 A * 3/1891 Jewell
1,415,730 A * 5/1922 Taylor ..... 188/53
1,939,106 A * 12/1933 Clouser ..... 188/53
2,517,199 A * 8/1950 Gothberg
2,722,291 A * 11/1955 Welp
3,707,208 A * 12/1972 Kyllonen
4,133,588 A * 1/1979 Earsley
4,147,238 A * 4/1979 Ames et al. ..... 188/57
5,000,298 A * 3/1991 Jackson et al. ..... 188/52
5,090,833 A * 2/1992 Oertle et al. ..... 403/290
5,806,634 A * 9/1998 Engle ..... 188/52
5,901,819 A * 5/1999 Engle ..... 188/219.1
6,102,167 A * 8/2000 Chiu
6,155,388 A * 12/2000 Sandmann
6,176,354 B1 * 1/2001 Sauter et al. ..... 188/220.1
6,234,283 B1 * 5/2001 Montes-Ramos
6,264,288 B1 * 7/2001 Dreese
6,279,696 B1 * 8/2001 Daugherty et al. ..... 188/219.1
6,398,314 B2 * 6/2002 Dreese
6,551,003 B1 * 4/2003 De La Fuente-Farias ..... 403/65
6,739,438 B1 * 5/2004 Leon-Rovira et al. ... 188/219.1

* cited by examiner

*Primary Examiner*—Daniel P. Stodola
*Assistant Examiner*—Victor MacArthur
(74) *Attorney, Agent, or Firm*—Abelman, Frayne & Schwab

(57) ABSTRACT

A pivoting joint for pivotally joining a brake head to a brake beam of a railway car allows the brake head to modify its radial and lateral direction with a controlled degree of rotation with respect to a bogie wheel, allowing the brake shoe to adapt to the wheel contour, and achieving an adequate force distribution along the brake shoe, and thus optimizing the utilization of the brake shoe material.

2 Claims, 5 Drawing Sheets

PIVOTING JOINT FOR PIVOTALLY JOINING A BRAKE HEAD TO A BRAKE BEAM

CROSS-REFERENCE TO RELATED APPLICATIONS

This invention is related to U.S. application Ser. No. 09/668,483, filed Sep. 25, 2000, now U.S. Pat. No. 6,551,003 B1, issued Apr. 22, 2003, which is incorporated herein by reference.

BACKGROUND OF THE INVENTION

1. Field of the Invention

The present invention is related to brake head assemblies for using in brake beams of railway cars, and more particularly to a pivoting joint for pivotally joining a brake head to a brake beam of a railway car by which an adequate force distribution along the brake shoe and an adequate contact between the brake shoes and the railway car bogie wheels are achieved.

2. Description of the Related Art

Most railroad freight cars and other transportation apparatus use a mechanism called brake rigging, classified generally as either a Body Mounted System (BMS) with an actuator on the car platform; a Truck Mounted System Direct Acting (TMS-DA) with an actuator on the beam; or a Truck Mounted System Indirect Acting (TMS-IA) with an actuator on the transportation apparatus, such as a truck, acting through levers on standard brake beams.

Generally, there is an air reservoir mounted on the car body, which provides pressurized air to at least one brake cylinder. In a BMS, the brake cylinder, in turn, supplies a mechanical force through a system of rods and driving levers to a truck driving lever system, usually consisting of two driving levers and a connecting rod. The driving levers move brake beams, which apply force to the treads of the wheels through interchangeable friction blocks or brake shoes, retarding the rotation of the wheels.

The conventional TMS brake rigging includes two brake beams per truck, at least one brake cylinder assembly per truck, and a driving lever or linkage assembly connected between the brake beams and the cylinder assembly.

There are many brake beam types that may be used in combination with the above-referred conventional brake rigging. One of the most commonly used brake beam types comprises: a compression member; a generally "V"-shaped tension member having its ends coupled to the ends of the compression member; a brake head linked to each end of the compression and/or tension members, each comprising a brake shoe carrier having a brake shoe; two end extensions, each linked at each end of the tension and/or compression member, or hanging means, by which the brake beam is coupled to the bogie of a railway car; and a fulcrum assembly attached to the compression member and tension member, so that the fulcrum remains between the tension and compression members. On the most common TMS-DA, there is also a cylinder assembly mounted in one of the beams, connected to its compression member, while the opposite beam in the same truck has a fulcrum or linkage means on the compression member to transfer the force of the cylinder to both beams, with an automatic double acting slack adjuster element between them, that extends via a trigger to compensate for the wear of the brake shoes.

Normally, the brake heads are fixedly linked to the brake beam by means of bolts passing through perforations located at the ends of the brake beam and through perforations located at the brake heads. Also, the brake heads may be linked to a brake beam by welding the brake head directly to the ends of the brake beam, or are integral to the beam ends as is the case of the cast beams.

The looseness between the extensions of the brake beam and its guides, which is necessary in order to compensate for the movements of the truck components when in operation, causes the brake beam to hang from the truck, so that its non-braking position does not point to the center of the wheel. Furthermore, during the braking operation, due to existent fixed joints between the extensions of the brake beam and its truck guides, between the brake heads and the wheels during the braking operation, and between the brake head and the brake beam, there is a double restriction that somehow buckles the displacement of the beam in the truck guides as well as its self-alignment towards the wheel center, so that the forces applied through the brake head are not transmitted uniformly along the brake shoe, thus producing a non-uniform and incomplete wear of the useful material of the brake shoes, which is a waste of useful material that could be properly used, and therefore, it is necessary to frequently change the brake shoe material which is a waste of time and money. In many occasions this uneven taper wear leaves the shoe material at the bottom of the shoes in as-new condition, while the top has already reached the condemnable limits, thus producing a material waste of approximately 50%.

In extreme cases, the material of the brake shoe is so worn at some points that the metal of the brake shoe carrier comes in direct contact with the corresponding bogie wheel, damaging the brake shoe carrier as well as the wheel.

It is also a common problem that, as the cars run through their cycle life, the components of its brake rigging system gradually wear out, aggravating the conditions of the beam hanging and buckling as referred above, thus further reducing the useful life of the brake shoes as the car ages.

Therefore, it would be desirable to have a brake head which allows a controlled degree of rotation of the brake head about a "z" axis (longitudinal rotation) and about a "y" axis (lateral rotation), so that it allows the brake shoe to pivot over the "z" and "y" axes and thus to completely adapt to the wheel thread.

Considering the above referred problems, the present applicant has developed in the present invention a pivoting joint for pivotally joining a brake head to a brake beam which pivotally joins the brake head to the brake beam in order to allow the brake head to modify its radial and lateral direction with a controlled degree of rotation with respect to the wheel, thus allowing the brake shoe to adapt to the wheel thread and achieving an adequate force distribution along the brake shoe.

The present invention provides a pivoting joint for pivotally joining a brake head to a brake beam, and comprises: means for pivotally joining the pivoting joint to the brake beam for allowing the pivoting joint and the brake head to laterally pivot; means for pivotally joining the brake head to the pivoting joint for allowing the brake head to radially pivot; friction means, cooperating with the means for pivotally joining the brake head to the pivoting linking means, for restricting the movement of the brake head with respect to the pivoting linking means; and mechanical rotation restriction means for restricting the brake head radial rotation angle within a predetermined angular range.

With the pivoting joint of the present invention, all the useful material of the brake shoe is totally used, thus avoiding frequent changes of the brake shoe material, which helps to achieve great money savings in view of the high maintenance costs caused by the frequent changes, and avoiding the waste of useful brake shoe material that still could be used if the thickness of the remaining material were uniform.

Furthermore, thanks to the brake head degree of rotation, torsional forces induced by the levers at certain angles during operation are reduced, thus extending the life of pins, levers, pocket guides, and the beam itself, by avoiding the buckling of the elements, and allowing the rigging system to apply a uniform force to all wheels on the transportation apparatus, such as a truck.

BRIEF SUMMARY OF THE INVENTION

It is therefore a main object of the present invention to provide a pivoting joint for pivotally joining a brake head to a brake beam.

It is also a main object of the present invention to provide a pivoting joint for pivotally joining a brake head to a brake beam, which allows the brake head to modify its radial and lateral direction with a controlled degree of rotation with respect to the brake beam by self-adjusting with respect to the wheel, thus transferring optimum braking forces to the wheels by preventing the buckling of its different elements, such as the end extensions on the truck guides and the lever on the strut, aiming to correct common brake problems in low braking applications and hand brake applications, for all types of brake rigging mechanisms (BMS & TMS).

It is a further object of the present invention to provide a pivoting joint for pivotally joining a brake head to a brake beam, by which a uniform force distribution is achieved along the brake shoe, thus allowing the brake shoe material of the brake head to adapt to the wheel thread as the material of the brake shoe is worn.

It is still another object of the present invention to provide a pivoting joint for pivotally joining a brake head to a brake beam, by which all the useful material of the brake shoe is totally used, thus avoiding frequent changes of the brake shoe material.

It is still another object of the present invention to provide a pivoting joint for pivotally joining a brake head to a brake beam, by which an uniform and complete wear of all the brake shoe material is achieved.

It is another object of the present invention to provide a pivoting joint for pivotally joining a brake head to a brake beam that reduces the torsional forces induced by the levers at certain angles during operation, thus extending the life of pins, levers, pocket guides, and the beam itself, by avoiding the buckling of the elements, and allowing the rigging system to apply a uniform force to all wheels on the transportation apparatus, such as a truck.

These and other objects and advantages of the pivoting joint for pivotally joining a brake head to a brake beam of the present invention will become apparent to those persons having ordinary skill in the art, from the following detailed description of the embodiments of the invention, which will be made with reference to the accompanying drawings.

BRIEF DESCRIPTION OF THE SEVERAL VIEWS OF THE DRAWINGS

Preferred embodiments of the invention are disclosed hereinbelow with reference to the drawings, wherein.

DETAILED DESCRIPTION OF THE INVENTION

As shown in FIGS. 1–5, the present invention can be used in various transportation apparatus which employ brake systems, such as the brake system described in co-pending U.S. application Ser. No. 09/668,483, filed Sep. 25, 2000, which is incorporated herein by reference. Although described herein with reference to an example embodiment for a railroad car, the present invention may be implemented in various transportation apparatus not limited to railroad cars, such as trucks and other vehicles using brake systems.

Figure 1:
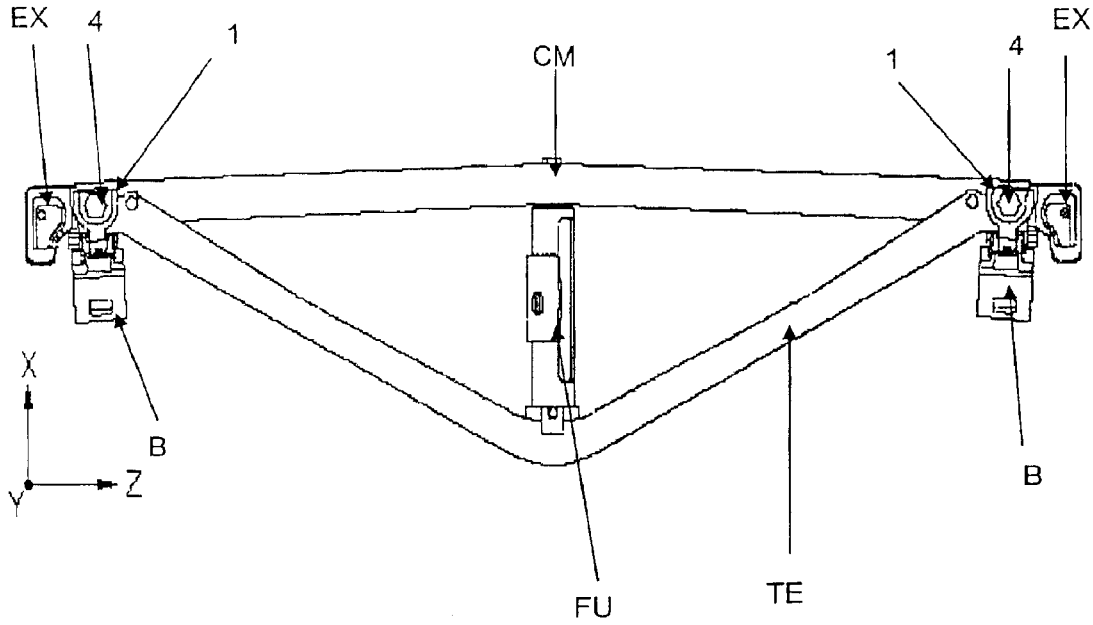
FIG. 1 is a front view of a brake beam having the pivoting joint for pivotally joining a brake head to a brake beam of the present invention and showing a diagram of the rotational axis.

Referring to FIG. 1, a typical brake beam comprises: a compression member "CM", a generally "V" shaped tension member "TE" having its ends coupled to the ends of the compression member "CM", each end including a first and a second longitudinal side and a first and a second end, a brake head "B" linked to each end of the compression and/or tension member, two end extensions "EX" or hanging means by which the brake beam is coupled to the bogie of a railway car, and a fulcrum "FU" assembled, cast, or welded to the compression member and the tension member.

Figure 2:
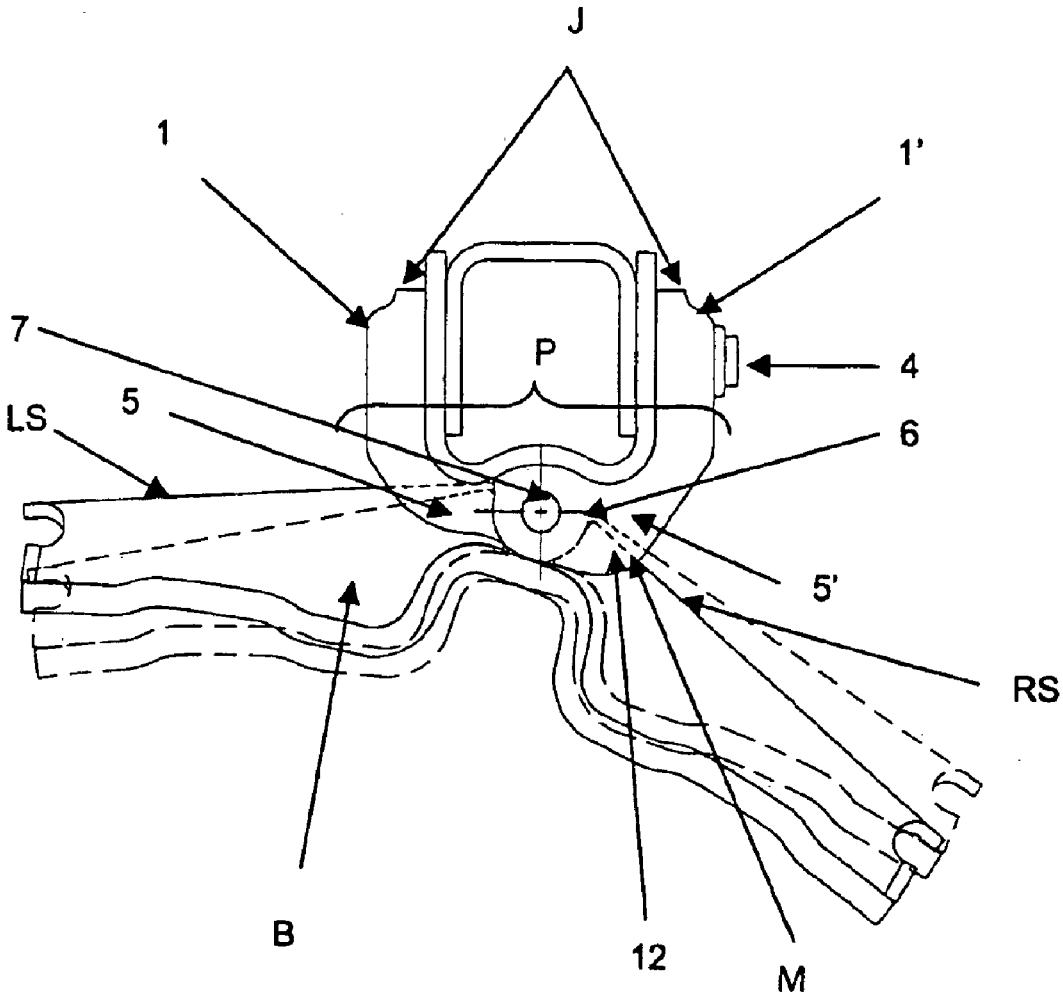
FIG. 2 is a lateral view of the pivoting joint for pivotally joining a brake head to a brake beam of the present invention in accordance with a preferred embodiment thereof.
Figure 5:
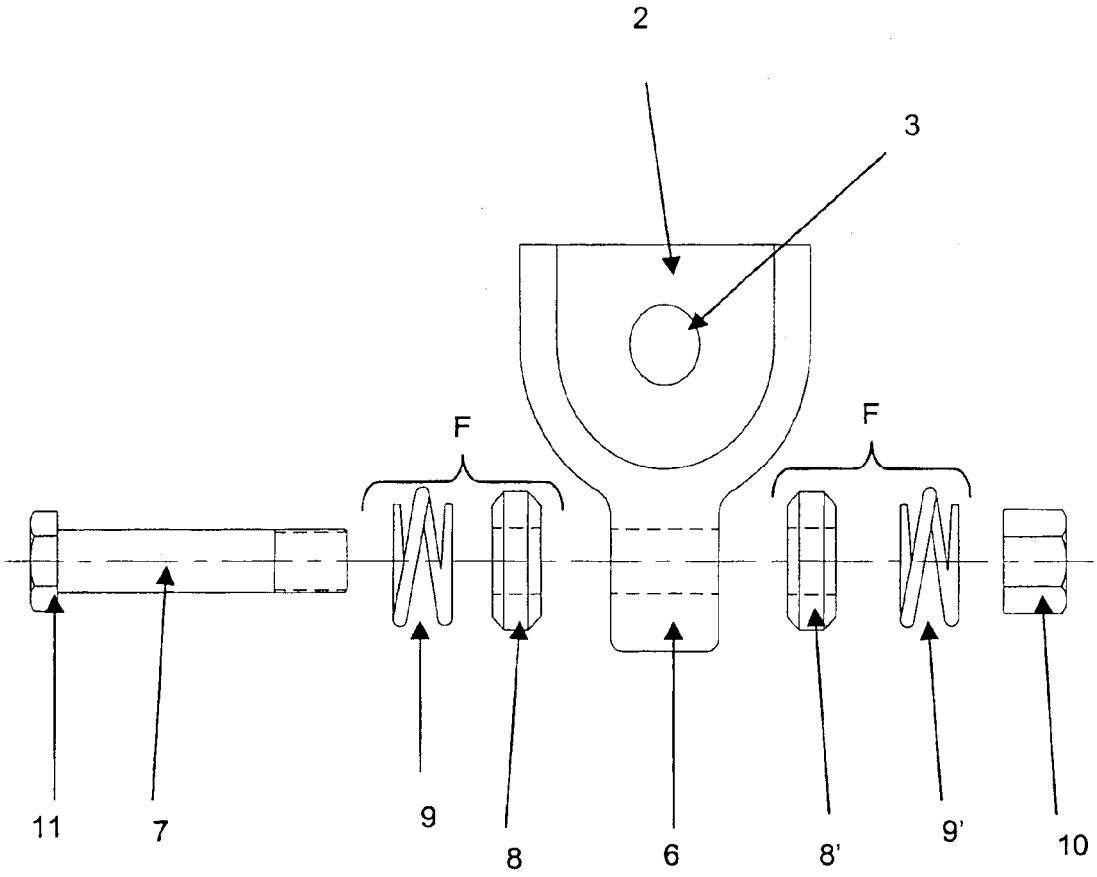
FIG. 5 is a lateral view with parts separated of the friction means in accordance with a preferred embodiment thereof.

As shown in FIGS. 2 and 5, a typical brake head comprises linking means for linking the brake head to the brake beam, having left "LS" and right "RS" inclined superior surfaces and brake shoe material.

The pivoting joint for pivotally joining a brake head to a brake beam for allowing the brake head to pivot about a "z" axis (angular rotation) and about "y" axis (lateral rotation of the brake head) with a controlled degree of freedom with respect to the brake beam will be described in accordance with a first embodiment thereof referring to a typical brake beam and brake head, wherein the pivoting joint for pivotally joining a brake head to a brake beam comprises:

means "J" for pivotally joining the pivoting joint to the brake beam for allowing the pivoting joint and the brake head "B" to pivot about the "y" axis comprising: a pair of bracket ends 1, 1' each including a central planar screw-nut receiving section 2 having a perforation 3 coinciding with perforations located at the ends of the brake beam (not shown), for receiving a bolt or screw 4, thus pivotally joining the means for pivotally joining the pivoting joint to the brake beam to the ends of the brake beam so that the cross-section of the brake beam remains between both bracket ends 1, 1';

means "P" for pivotally joining the brake head "B" to the pivoting joint for allowing the brake head "B" to pivot about the "z" axis, comprising: a pair of connection sections 5, 5' each depending from a respective bracket end 1, 1' so that both connection sections 5,5' remain perpendicular to the screw-nut planar receiving section 2 and parallel to the brake beam cross-section; and a circular brake head pivoting connection section 6 depending from both connection sections 5,5' and located between them, the circular brake head pivoting connection including a central perforation (not shown) coinciding with perforations located at the brake head for receiving a screw 7, thus pivotally joining the brake head "B" to the means for pivotally joining the pivoting joint to the brake beam;

friction means "F" cooperating with the screw 7, for restricting the movement of the brake head "B" with respect to the pivoting joint comprising a pair of bushings 8, 8', shown in FIG. 5, each coinciding with the pivoting connection central perforation and each located at each side of the pivoting connection 6, with a left spring 9 and a right spring 9' each respectively located at each side of each bushing 8, 8', and a lock nut 10 located beside the right spring 9', such that the screw 7 passes through the springs 9, 9', the bushings 8, 8', the brake head perforations, and the pivoting connection central perforation, and is secured by the nut 10, such that both springs 9, 9' are compressed by the tension assembly formed by the screw head 11 and the nut 10, so that each spring 9, 9' compresses a respective bushing 8, 8', which in turn applies a pressure against the brake head "B" at the portion in which it is linked with the pivoting linking means, thus restricting but not preventing its movement, and furthermore the friction means allows the brake head "B" to remain in its last auto-adjusted position achieved in the last braking action; and mechanical rotation restriction means "M" for restricting the brake head "B" rotation angle about the "z" axis only within a predetermined angular range, comprising: a downward projection 12 depending from one of the connection sections 5' forming bump means, with the projection 12 bumping into the superior surface of the brake head "B", thus limiting the rotation to the side in which the projection 12 is located, such that the rotation to the opposite side is limited by one of the edges of the brake head "B" which bumps into the brake beam end and/or a connection section 5 of the upper bump means.

Figure 3:
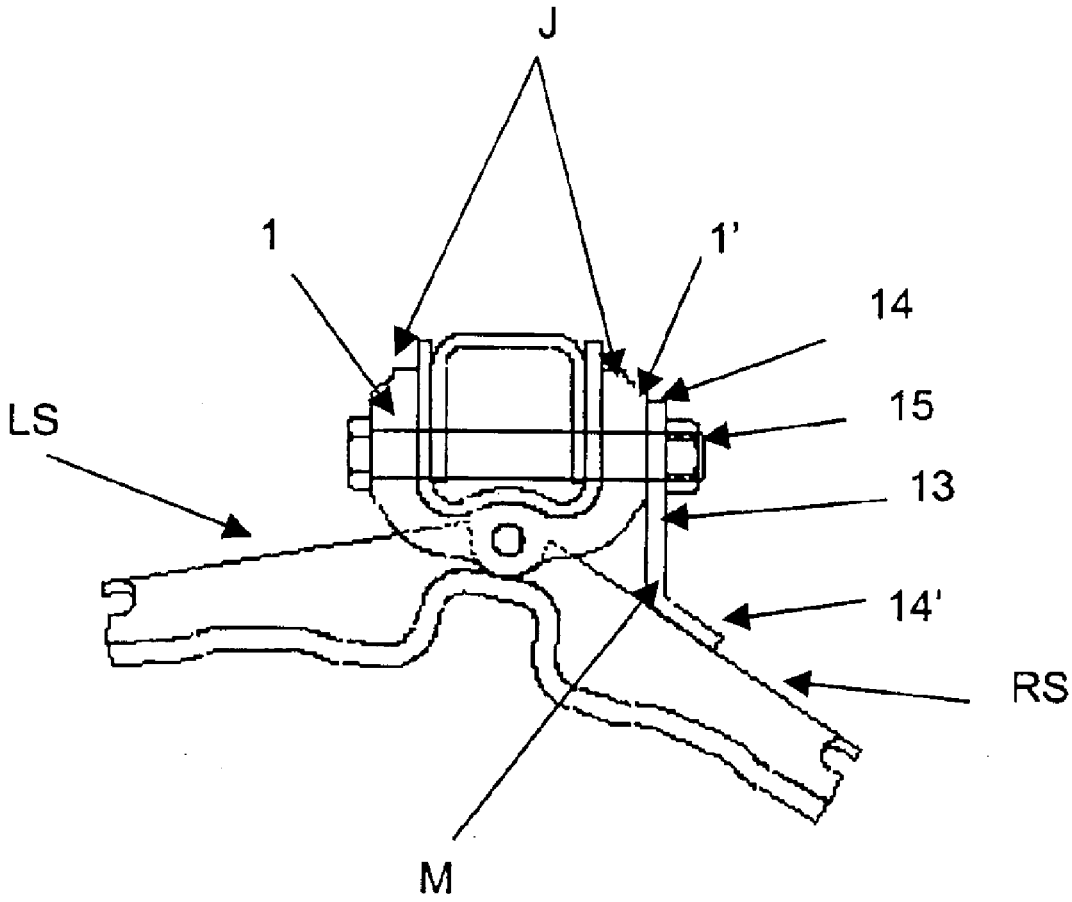
FIG. 3 is a lateral view of the pivoting joint for pivotally joining a brake head to a brake beam of the present invention in accordance with a preferred embodiment thereof including mechanical rotation restriction means.

The mechanical rotation restriction means "M" may also include spring means for returning the brake head to an optimum position after the brakes have been released, by pushing and rotating the brake head about the "z" axis until the edge of the brake head bumps into the brake beam end. As shown in FIG. 3, the spring means may comprise: a flexible "L" shaped piece 13 having a first plaque section 14 and a second plaque section 14', wherein the first plaque section 14 includes a perforation (not shown) coinciding with the perforation of the central planar screw-nut receiving section of one of the bracket ends 1, 1' for receiving a screw 15, thus assembling the "L" shaped piece to the pivoting joint so that the second plaque section 14' contacts the right inclined superior surface "RS" of the brake head and constantly pushes it downwardly.

Figure 4:
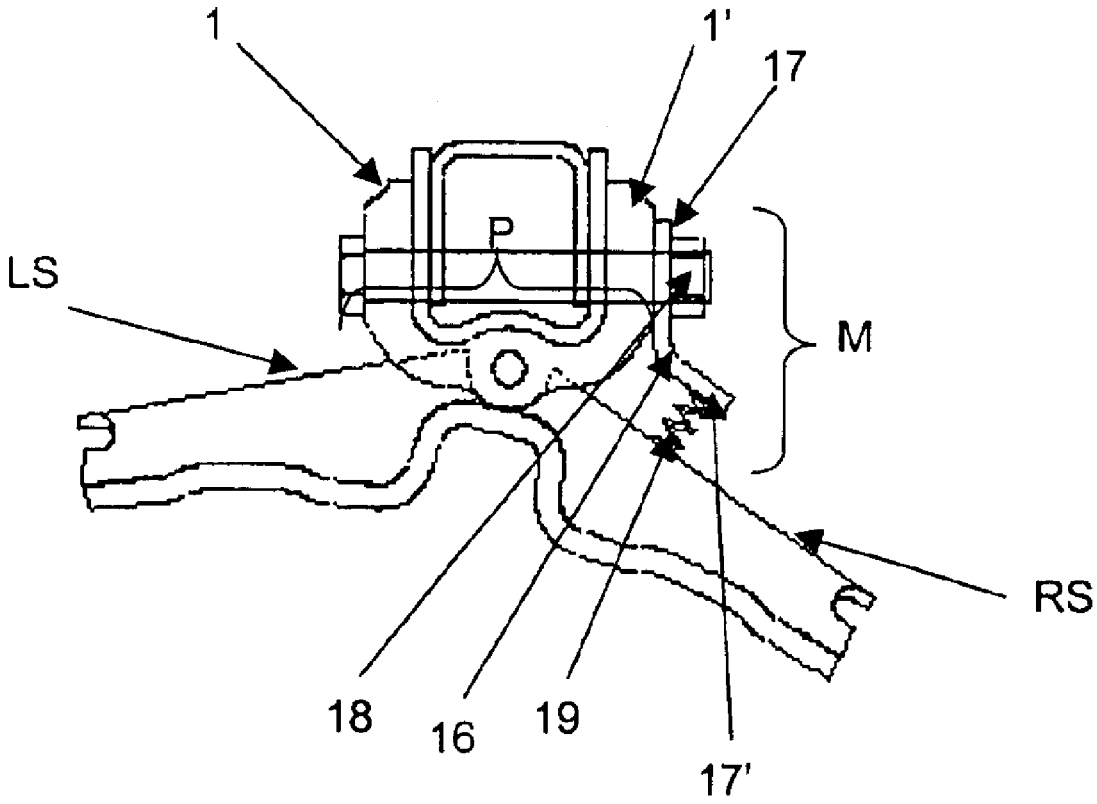
FIG. 4 is a lateral view of the pivoting joint for pivotally joining a brake head to a brake beam of the present invention in accordance with a preferred embodiment thereof including alternative mechanical rotation restriction means.

Also, as shown in FIG. 4, the spring means may be comprised of an "L" shaped piece 16 having a first perpendicular and flexible plaque section 17 and a second perpendicular and flexible plaque section 17', wherein the first plaque section 17 includes a perforation (not shown) coinciding with the perforation of the central planar screw-nut receiving section of one of the bracket ends 1,1' for receiving a nut-screw assembly 18 thus assembling the "L" shaped piece 16 to the pivoting joint so that the second plaque section 17' remains opposed to the brake head left superior surface, leaving a space between the second plaque section 17' and the right brake head's inclined superior surface. A spring 19 is welded to the second plaque section 17' and remains in the space between the second plaque section 17' and the brake head right superior surface RS, contacting it and constantly pushing it downwardly.

The means for pivotally joining the pivoting joint to the brake beam may comprise any means that allow the brake head to pivot about the "y" axis, for example, a ball bearing union or a dovetail joint.

The pivoting joint for pivotally joining a brake head to a brake beam of the present invention allows the brake head "B" to laterally pivot about the "z" axis" and to radially pivot about the "y" axis with friction and within a predetermined angular range, thus allowing the brake head "B" to self-align with respect to the wheel in any direction as the brake shoe material is worn, by which an adequate force distribution along the brake shoe and an adequate contact of all the brake shoe material with the wheel when the brakes are applied are achieved during all the useful life of the brake shoe material. Thus, all the material of the brake shoe is used, avoiding frequent brake shoe changes and frequent brake beam head damage.

Finally it must be understood that the pivoting joint for pivotally joining a brake head to a brake beam of the present invention is not limited exclusively to the above described and illustrated embodiments and that persons having ordinary skill in the art, with the teaching provided by this invention, can make modifications to the design and component distribution of the pivoting joint for pivotally joining a brake head to a brake beam of the present invention, which will clearly be within the true inventive concept and scope of the invention which is claimed in the following claims.

What is claimed is:

1. A pivoting joint for pivotally joining a brake head to a brake beam, wherein the brake beam has two ends, each end receiving a respective brake head, and wherein the brake head has left and right inclined superior surfaces and includes linking means for linking the brake head to the brake beam and a brake shoe, the pivoting joint comprising:

means for pivotally joining a pivoting joint to the brake beam including:

a pair of bracket ends, each including a central planar screw-nut receiving section having a perforation coinciding with perforations located at the ends of the brake beam, for receiving a respective screw, thus pivotally joining the means for pivotally joining a pivoting joint to the brake beam to the ends of the brake beam;

means for pivotally joining the brake head to a pivoting joint including:

a pair of perpendicularly-oriented connection sections perpendicularly depending from both bracket ends so that both perpendicularly-oriented connection sections remain perpendicular to a respective screw-nut planar receiving section and parallel to the brake beam cross-section; and a circular brake head pivoting connection section depending from both perpendicularly-oriented connection sections and located between them, the circular brake head pivoting connection including:

a central perforation coinciding with perforations located at the brake head for receiving a screw having a head, thus pivotally joining the brake head to the means for pivotally joining a pivoting joint to the brake beam;

friction means cooperating with the screw received in the brake head pivoting connection central perforation and including:

a pair of bushings, each coinciding with the pivoting connection central perforation and each located at each side of the pivoting connection;

a pair of springs each located at both sides of each bushing;

a lock nut located beside one of the springs; and mechanical rotation restriction means for restricting the brake head radial rotation angle to be within a predetermined angular range:

wherein the screw, received in the brake head pivoting connection central perforation, passes through the springs, bushings, brake head perforations, and the pivoting connection central perforation, and is secured by the nut, and wherein the pair of springs are compressed by a head of the screw and by the nut, so that the springs compress a bushing which in turn applies a pressure against the brake head at the portion in which it is linked with the pivoting linking means, thus restricting but not preventing the movement of the brake head.

2. A pivoting joint for pivotally joining a brake head to a brake beam, wherein the brake beam has two ends, each end receiving a respective brake head, and wherein the brake head has left and right inclined superior surfaces and includes linking means for linking the brake head to the brake beam and a brake shoe, the pivoting joint comprising:

means for pivotally joining a pivoting joint to the brake beam for allowing a pivoting joint and the brake head to laterally pivot;

means for pivotally joining the brake head to a pivoting joint for allowing the brake head to radially pivot;

friction means, cooperating with the means for pivotally joining the brake head, for restricting the movement of the brake head with respect to the linking means; and mechanical rotation restriction means for restricting the brake head radial rotation angle to within a predetermined angular range;

wherein the means for pivotally joining a pivoting joint to the brake beam includes:

a plurality of bracket ends, each including a central planar screw-nut receiving section having a perforation coinciding with perforations located at the ends of the brake beam, for receiving a respective screw, thus pivotally joining the means for pivotally joining a pivoting joint to the brake beam to the ends of the brake beam;

wherein the means for pivotally joining the brake head to a pivoting joint includes:

a plurality of perpendicularly-oriented connection sections perpendicularly depending from both bracket ends so that both perpendicularly-oriented connection sections remain perpendicular to a respective screw-nut planar receiving section and parallel to the brake beam cross-section; and a circular brake head pivoting connection section depending from both perpendicularly-oriented connection sections and located between them, the circular brake head pivoting connection including:

a central perforation coinciding with perforations located at the brake head for receiving a screw having a head, thus pivotally joining the brake head to the means for pivotally joining a pivoting joint to the brake beam; and wherein the friction means cooperates with the screw received in the brake head pivoting connection central perforation and includes:

a plurality of bushings, each coinciding with the pivoting connection central perforation and each located at each side of the pivoting connection;

a plurality of springs each located at both sides of each bushing; and a lock nut located beside one of the springs;

wherein the screw, received in the brake head pivoting connection central perforation, passes through the springs, bushings, brake head perforations, and the pivoting connection central perforation, and is secured by the nut, and wherein the plurality of springs are compressed by a head of the screw and by the nut, so that the springs compress a bushing which in turn applies a pressure against the brake head at the portion in which it is linked with the pivoting linking means, thus restricting but not preventing the movement of the brake head.

* * * * *